US009754743B1

(12) United States Patent
LaFountain et al.

(10) Patent No.: US 9,754,743 B1
(45) Date of Patent: Sep. 5, 2017

(54) ACTUATION APPARATUS FOR MAGNETICALLY-TRIGGERED PROXIMITY SWITCHES

(71) Applicant: GENERAL EQUIPMENT AND MANUFACTURING COMPANY, INC., Louisville, KY (US)

(72) Inventors: Robert L. LaFountain, Charlestown, IN (US); Brian Hampton, Greenville, IN (US); James McDill, Coxs Creek, KY (US); Bruce Rigsby, Charlestown, IN (US); Michael Simmons, Louisville, KY (US)

(73) Assignee: GENERAL EQUIPMENT AND MANUFACTURING COMPANY, INC., Louisville, KY (US)

( * ) Notice: Subject to any disclaimer, the term of this patent is extended or adjusted under 35 U.S.C. 154(b) by 0 days.

(21) Appl. No.: 15/058,880

(22) Filed: Mar. 2, 2016

(51) Int. Cl.
*H01H 36/00* (2006.01)
*H01H 11/00* (2006.01)

(52) U.S. Cl.
CPC ..... *H01H 36/0073* (2013.01); *H01H 11/00* (2013.01)

(58) Field of Classification Search
CPC ..... H01H 36/0073; H01H 11/00
See application file for complete search history.

(56) References Cited

U.S. PATENT DOCUMENTS 4,117,431 A 9/1978 Eicher
4,150,350 A 4/1979 Fong
4,674,338 A 6/1987 Carpenter
4,837,539 A 6/1989 Baker
5,877,664 A 3/1999 Jackson, Jr.
(Continued)

FOREIGN PATENT DOCUMENTS

DE 7007531 8/1970
DE 3340419 5/1985
(Continued)

OTHER PUBLICATIONS

Patent Cooperation Treaty, "International Search Report and Written Opinion of the International Searching Authority," issued in connection with Application No. PCT/US2011/038949, Sep. 2, 2011, 12 pages.
(Continued)

*Primary Examiner* — Mohamad Musleh
(74) *Attorney, Agent, or Firm* — Hanley, Flight & Zimmerman, LLC

(57) ABSTRACT

Actuation apparatus for use with magnetically-triggered proximity switches are described herein. An example apparatus includes an actuator shaft having a first segment and a second segment, the first segment intersecting the second segment. The first segment defines a first end of the actuator shaft, and the second segment defines a second end of the actuator shaft opposite the first end. The second segment further defines a slot. The apparatus further includes a detector magnet assembly coupled to the first segment of the actuator shaft adjacent the first end. The apparatus further includes a switch arm coupled to the second segment of the actuator shaft. The switch arm includes a first end, a second end opposite the first end, and a portion located between the first and second ends of the switch arm. The portion of the switch arm is positioned in the slot of the actuator shaft.

20 Claims, 7 Drawing Sheets

(56) References Cited

U.S. PATENT DOCUMENTS

| | | | |
|---|---|---|---|
| 7,187,259 | B1 | 3/2007 | Habboosh |
| 8,362,859 | B2 | 1/2013 | Pearce et al. |
| 8,400,241 | B2 | 3/2013 | Simmons |
| 2002/0149454 | A1 | 10/2002 | Nishikawa |
| 2008/0266035 | A1 | 10/2008 | Rohrig et al. |

FOREIGN PATENT DOCUMENTS

| | | |
|---|---|---|
| EP | 0320112 | 6/1989 |
| FR | 2386121 | 10/1978 |

OTHER PUBLICATIONS

International Searching Authority, "International Search Report and Written Opinion," issued in connection with PCT application No. PCT/US2017/018315, dated May 22, 2017, 14 pages.

ACTUATION APPARATUS FOR MAGNETICALLY-TRIGGERED PROXIMITY SWITCHES

FIELD OF THE DISCLOSURE

This disclosure relates generally to actuation apparatus and, more particularly, to actuation apparatus for use with magnetically-triggered proximity switches.

BACKGROUND

Magnetically-triggered proximity switches, also known as limit switches, are commonly used for linear position sensing. Examples of such magnetically-triggered proximity switches are described in U.S. Pat. No. 8,362,859, the entirety of which is incorporated by reference herein.

Magnetically-triggered proximity switches typically detect the presence and/or proximity of a target without physically contacting the target. When the target, which may include, for example, a ferrous object or a permanent magnet contained in a housing, is beyond a specified range of the proximity switch, a magnetic flux associated with a bias magnet that is non-movably positioned in the proximity switch causes a detector magnet that is movably positioned in the proximity switch to be drawn toward the bias magnet, which places the proximity switch in a first switch position. In the first switch position, a normally open circuit of the proximity switch is open, and a normally closed circuit of the proximity switch is closed.

When the target passes within the specified range of the proximity switch, a magnetic flux associated with the target triggers and/or causes the detector magnet of the proximity switch to be drawn toward the target and away from the bias magnet, which places the proximity switch in a second switch position. In the second switch position, the normally open circuit of the proximity switch is closed, and the normally closed circuit of the proximity switch is open.

SUMMARY

An example apparatus for use with a magnetically-triggered proximity switch includes an actuator shaft having a first segment and a second segment. The first segment intersects the second segment. The first segment defines a first end of the actuator shaft, and the second segment defines a second end of the actuator shaft opposite the first end. The second segment further defines a slot. The example apparatus further includes a detector magnet assembly coupled to the first segment of the actuator shaft adjacent the first end of the first segment. The example apparatus further includes a switch arm coupled to the second segment of the actuator shaft. The switch arm has a first end, a second end opposite the first end of the switch arm, and a portion located between the first and second ends of the switch arm. The portion of the switch arm is positioned in the slot of the second segment of the actuator shaft.

An example method to assemble an example apparatus for use with a magnetically-triggered proximity switch includes coupling a detector magnet assembly to a first segment of an actuator shaft. When coupled to the first segment of the actuator shaft, the detector magnet assembly abuts a mechanical stop positioned on the first segment of the actuator shaft. The example method further includes coupling a switch arm to a second segment of the actuator shaft. The second segment of the actuator shaft intersects the first segment of the actuator shaft. The switch arm includes a first end, a second end opposite the first end, and a portion located between the first and second ends of the switch arm. When coupled to the second segment of the actuator shaft, the portion of the switch arm is positioned in a slot defined by the second segment of the actuator shaft.

DETAILED DESCRIPTION

Figure 1:
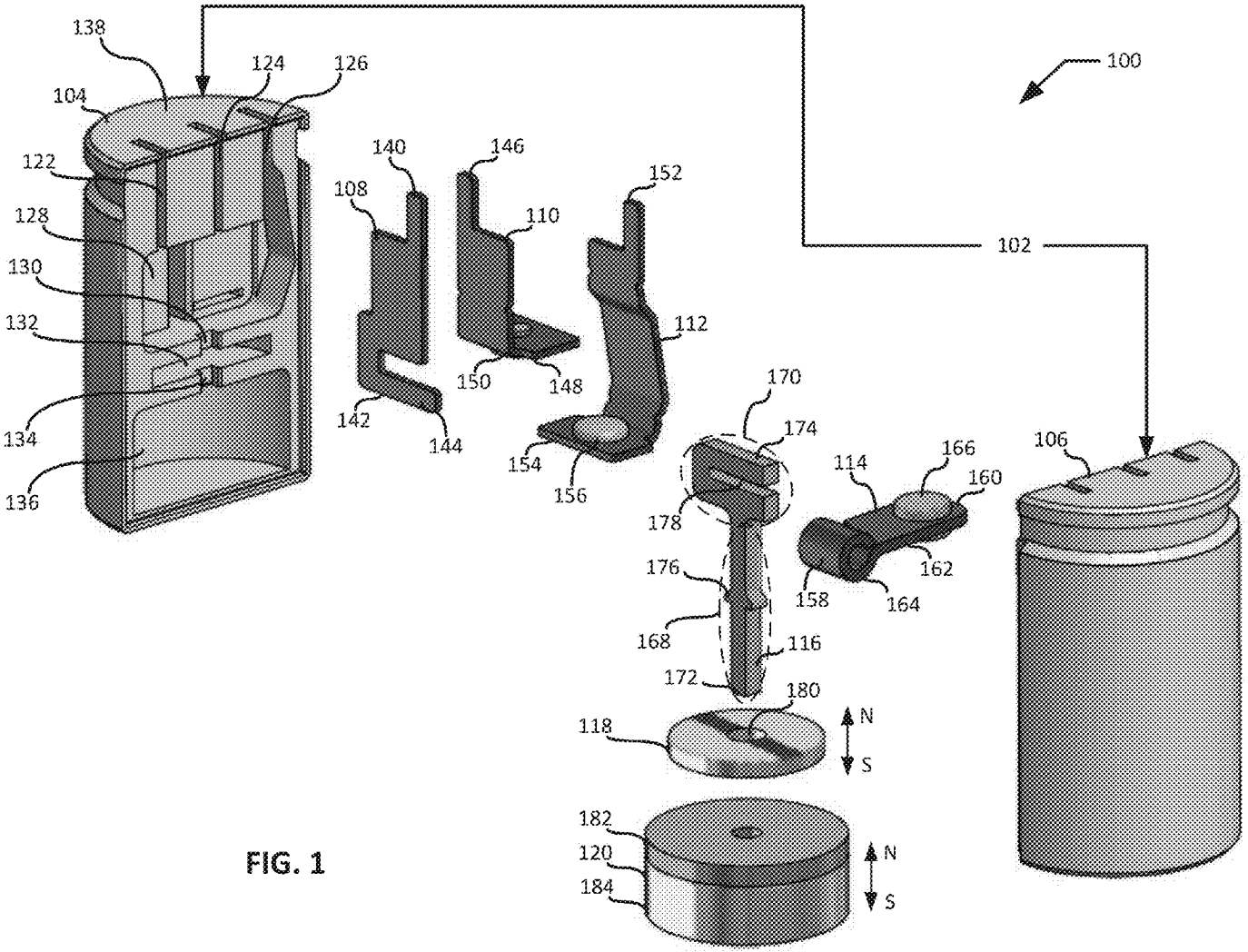
FIG. 1 is an exploded view of an example proximity switch having an improved actuation apparatus.

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity and/or conciseness.

A known proximity switch, as described in U.S. Pat. No. 8,362,859, includes a switch arm having an aperture proximate a middle portion of the switch arm for receiving an end of an actuator rod. In conjunction with the manufacture and/or assembly of the known proximity switch, the end of the actuator rod is inserted through the aperture of the switch arm, and the end of the actuator rod is then secured to the switch arm by mechanical fastening.

The example apparatus described herein provides an improved actuation apparatus for use in a magnetically-triggered proximity switch. The example apparatus includes an actuator shaft having a slot configured to receive a portion of a switch arm. The example configuration of the actuator shaft and the switch arm provides for increased control of the interface tolerance between the switch arm and the actuator shaft, which decreases the variability associated with manufacturing and/or assembling proximity switches implementing the improved actuation apparatus. The interface of the switch arm and the actuator shaft also provides for a decrease in the time associated with manufacturing and/or assembling a proximity switch implementing the improved actuation apparatus. Furthermore, unlike the switch arm of the known proximity switch, the switch arm of the example apparatus does not include an aperture proximate the middle portion of the switch arm. As a result of eliminating the aperture, the switch arm of the example apparatus is stronger and/or more robust relative to the switch arm of the known proximity switch. As a further result of eliminating the aperture, the manufacturing and/or machining process used to form the switch arm of the example apparatus is simplified relative to the manufacturing and/or machining process used to form the switch arm of the known proximity switch.

In some disclosed examples, the apparatus includes an actuator shaft having a first segment and a second segment. In some disclosed examples, the first segment intersects the second segment. In some disclosed examples, the first and second segments are integrally formed. In some disclosed examples, the first segment defines a first end of the actuator shaft. In some disclosed examples, the first segment further defines a longitudinal axis of the actuator shaft. In some disclosed examples, the first segment includes a mechanical stop. In some disclosed examples, the second segment defines a second end of the actuator shaft opposite the first end. In some disclosed examples, the second segment further defines a slot. In some disclosed examples, the second segment includes a base segment, a first leg segment, and a second leg segment. In some disclosed examples, the second leg segment is spaced apart from the first leg segment. In some disclosed examples, the first segment intersects the first leg segment of the second segment. In some disclosed examples, the base segment includes a first end and a second end opposite the first end. In some disclosed examples, the first leg segment extends from the first end of the base segment at a first angle, and the second leg segment extends from the second end of the base segment at a second angle. In some disclosed examples, the base segment of the second segment is substantially parallel to the first segment. In some disclosed examples, the first leg segment is substantially parallel to the second leg segment. In some disclosed examples, the first leg segment is substantially perpendicular to the base segment.

In some disclosed examples, the apparatus further includes a detector magnet assembly coupled to the first segment of the actuator shaft adjacent the first end of the first segment. In some disclosed examples, the detector magnet assembly abuts the mechanical stop of the first segment of the actuator shaft when the detector magnet assembly is coupled to the first segment of the actuator shaft. In some disclosed examples, the detector magnet assembly includes a detector magnet and a detector magnet retainer. In some disclosed examples, the detector magnet includes a first aperture configured to receive the detector magnet retainer. In some disclosed examples, the detector magnet retainer includes a second aperture configured to be positioned within the first aperture of the detector magnet and further configured to receive the first end of the first segment of the actuator shaft. In some disclosed examples, the detector magnet assembly is formed by coupling the detector magnet to the detector magnet retainer. In some disclosed examples, coupling the detector magnet to the detector magnet retainer includes swaging the detector magnet retainer. In some disclosed examples, coupling the detector magnet assembly to the first segment of the actuator shaft includes swaging the first segment of the actuator shaft.

In some disclosed examples, the apparatus further includes a switch arm coupled to the second segment of the actuator shaft. In some disclosed examples, the switch arm has a first end, a second end opposite the first end of the switch arm, and a portion located between the first and second ends of the switch arm. In some disclosed examples, the portion of the switch arm is positioned in the slot of the second segment of the actuator shaft when the switch arm is coupled to the second segment. In some disclosed examples, the switch arm includes a ring segment adjacent the first end of the switch arm and a common contact adjacent the second end of the switch arm. In some disclosed examples, the switch arm is configured to be pivotably movable between a first switch position and a second switch position.

An example magnetically-triggered proximity switch having an improved actuation apparatus is described herein in connection with FIGS. 1-12. FIG. 1 is an exploded view of an example proximity switch 100 having an improved actuation apparatus. The proximity switch 100 includes an example switch body 102 having an example first body half 104 and an example second body half 106. The proximity switch 100 further includes an example common terminal 108, an example primary terminal 110, an example secondary terminal 112, an example switch arm 114, an example actuator shaft 116, an example bias magnet 118, and an example detector magnet assembly 120, all of which are configured to be received and/or positioned in the first body half 104 and/or the second body half 106 of the switch body 102.

Figure 2:
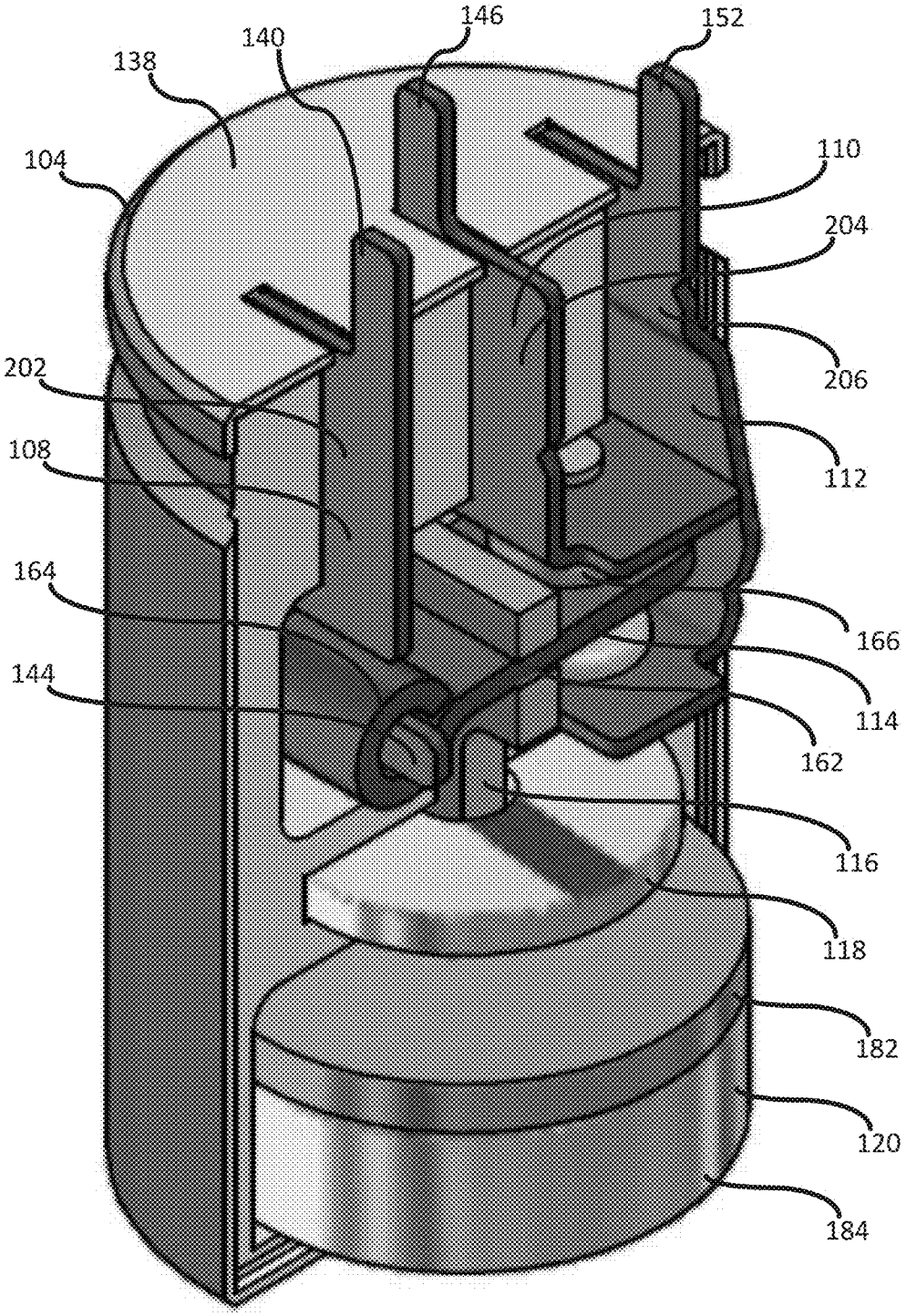
FIG. 2 is a partial cutaway view of the example proximity switch of FIG. 1.

FIG. 2 is a partial cutaway view of the example proximity switch 100. FIG. 2 illustrates the common terminal 108, the primary terminal 110, the secondary terminal 112, the switch arm 114, the actuator shaft 116, the bias magnet 118, and the detector magnet assembly 120 assembled in the first body half 104 of the switch body 102.

As shown in FIGS. 1 and 2, the first body half 104 of the switch body 102 includes an example first channel 122, an example second channel 124, an example third channel 126, an example first cavity 128, an example second cavity 130, an example third cavity 132, an example fourth cavity 134, and an example fifth cavity 136. In the illustrated example, the first, second and third channels 122, 124, 126 are substantially parallel to one another. Each of the first, second and third channels 122, 124, 126 extends from an exterior surface 138 of the first body half 104 to the first cavity 128 of the first body half 104. The first channel 122 is configured to receive a portion of the common terminal 108, the second channel 124 is configured to receive a portion of the primary terminal 110, and the third channel 126 is configured to receive a portion of the secondary terminal 112. The first cavity 128 is configured to receive a portion of each of the common, primary and secondary terminals 108, 110, 112, as well as the switch arm 114 and a portion of the actuator shaft 116. The second cavity 130 is configured to receive a portion of the actuator shaft 116. The third cavity 132 is configured to receive the bias magnet 118. The fourth cavity 134 is configured to receive a portion of the actuator shaft 116, and the fifth cavity 136 is configured to receive the detector magnet assembly 120.

The second body half 106 of the switch body 102 is complimentary to the first body half 104 and includes channels and cavities corresponding to the first, second and third channels 122, 124, 126 and the first, second, third, fourth and fifth cavities 128, 130, 132, 134, 136 of the first body half 104 described above. The second body half 106 is configured to be rigidly coupled to the first body half 104 via any suitable type of fastener(s) and/or adhesive(s) to form the switch body 102 of the example proximity switch 100.

The common terminal 108 of the proximity switch 100 includes an example first end 140, an example second end 142 opposite the first end 140, and an example middle portion 202 located between the first and second ends 140, 142. When the common terminal 108 is positioned in the first body half 104 (as shown in FIG. 2) and/or the second body half 106 of the switch body 102, the first end 140 of the common terminal 108 is positioned outside of the switch body 102, the middle portion 202 of the common terminal 108 is positioned in the first channel 122, and the second end 142 of the common terminal 108 is positioned in the first cavity 128. The common terminal 108 further includes an example hook segment 144 formed proximate the second end 142 of the common terminal 108. The hook segment 144 is configured to electrically contact and pivotably retain a portion of the switch arm 114, as described in greater detail below.

The primary terminal 110 of the proximity switch 100 includes an example first end 146, an example second end 148 opposite the first end 146, and an example middle portion 204 located between the first and second ends 146, 148. When the primary terminal 110 is positioned in the first body half 104 (as shown in FIG. 2) and/or the second body half 106 of the switch body 102, the first end 146 of the primary terminal 110 is positioned outside of the switch body 102, the middle portion 204 of the primary terminal 110 is positioned in the second channel 124, and the second end 148 of the primary terminal 110 is positioned in the first cavity 128. The primary terminal 110 further includes an example primary contact 150 positioned at the second end 148 of the primary terminal 110. The primary contact 150 is configured to electrically contact a portion of the switch arm 114 when the switch arm 114 is in a first switch position, as described in greater detail below.

The secondary terminal 112 of the proximity switch 100 includes an example first end 152, an example second end 154 opposite the first end 152, and an example middle portion 206 located between the first and second ends 152, 154. When the secondary terminal 112 is positioned in the first body half 104 (as shown in FIG. 2) and/or the second body half 106 of the switch body 102, the first end 152 of the secondary terminal 112 is positioned outside of the switch body 102, the middle portion 206 of the secondary terminal 112 is positioned in the third channel 126, and the second end 154 of the secondary terminal 112 is positioned in the first cavity 128. The secondary terminal 112 further includes an example secondary contact 156 positioned at the second end 154 of the secondary terminal 112. The secondary contact 156 is configured to electrically contact a portion of the switch arm 114 when the switch arm 114 is in a second switch position, as described in greater detail below.

Figure 3:
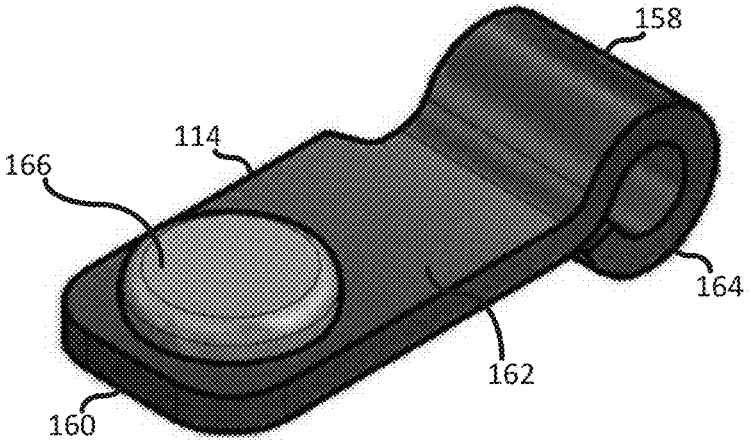
FIG. 3 is a perspective view of an example switch arm of the example proximity switch of FIGS. 1 and 2.
Figure 4:
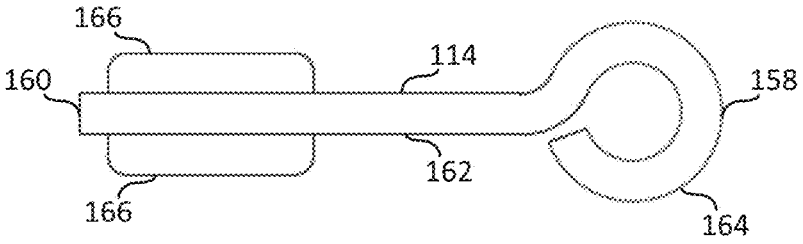
FIG. 4 is a side view of the example switch arm of FIGS. 1-3.
Figure 5:
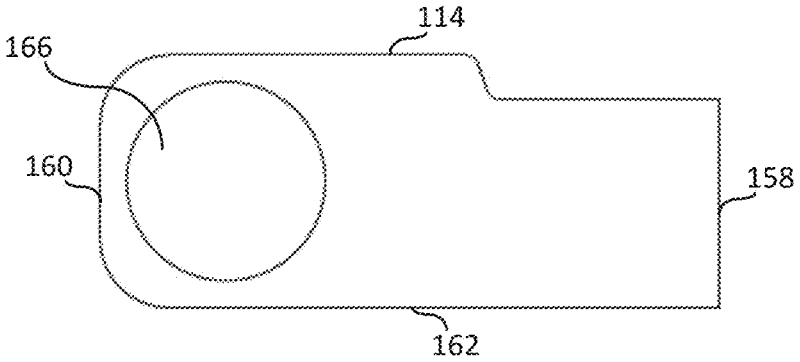
FIG. 5 is a plan view of the example switch arm of FIGS. 1-4.

FIGS. 3, 4 and 5 are, respectively, perspective, side and plan views of the example switch arm 114 of FIGS. 1 and 2. The switch arm 114 of the proximity switch 100 includes an example first end 158, an example second end 160 opposite the first end 158, and an example middle portion 162 located between the first and second ends 158, 160. When the switch arm 114 is positioned in the first body half 104 (as shown in FIG. 2) and/or the second body half 106 of the switch body 102, the first end 158, second end 160 and middle portion 162 of the switch arm 114 are all positioned in the first cavity 128. The middle portion 162 of the switch arm 114 is configured to interface with and/or be received by a portion of the example actuator shaft 116, as described in greater detail below.

The switch arm 114 further includes an example ring segment 164 formed proximate the first end 158 of the switch arm 114. The ring segment 164 of the switch arm 114 is configured to receive and electrically contact the hook segment 144 of the common terminal 108, as shown in FIG. 2, such that the switch arm 114 is pivotably coupled to the common terminal 108. More specifically, the coupling between the hook segment 144 of the common terminal 108 and the ring segment 164 of the switch arm 114 enables the second end 160 of the switch arm 114 to pivot and/or rotate relative to and/or about the second end 142 of the common terminal 108. This pivotable coupling also provides an electrically conductive path between the first end 140 of the common terminal 108 through the switch arm 114 to an example common contact 166.

As shown, the common contact 166 is positioned at the second end 160 of the switch arm 114. When the switch arm 114 is positioned in the first body half 104 (as shown in FIG. 2) and/or the second body half 106 of the switch body 102, the common contact 166 is positioned between the primary contact 150 of the primary terminal 110 and the secondary contact 156 of the secondary terminal 112. The common contact 166 is configured to electrically contact the primary contact 150 of the primary terminal 110 when the switch arm 114 is in a first switch position, and is further configured to electrically contact the secondary contact 156 of the secondary terminal 112 when the switch arm 114 is in a second switch position.

Figure 6:
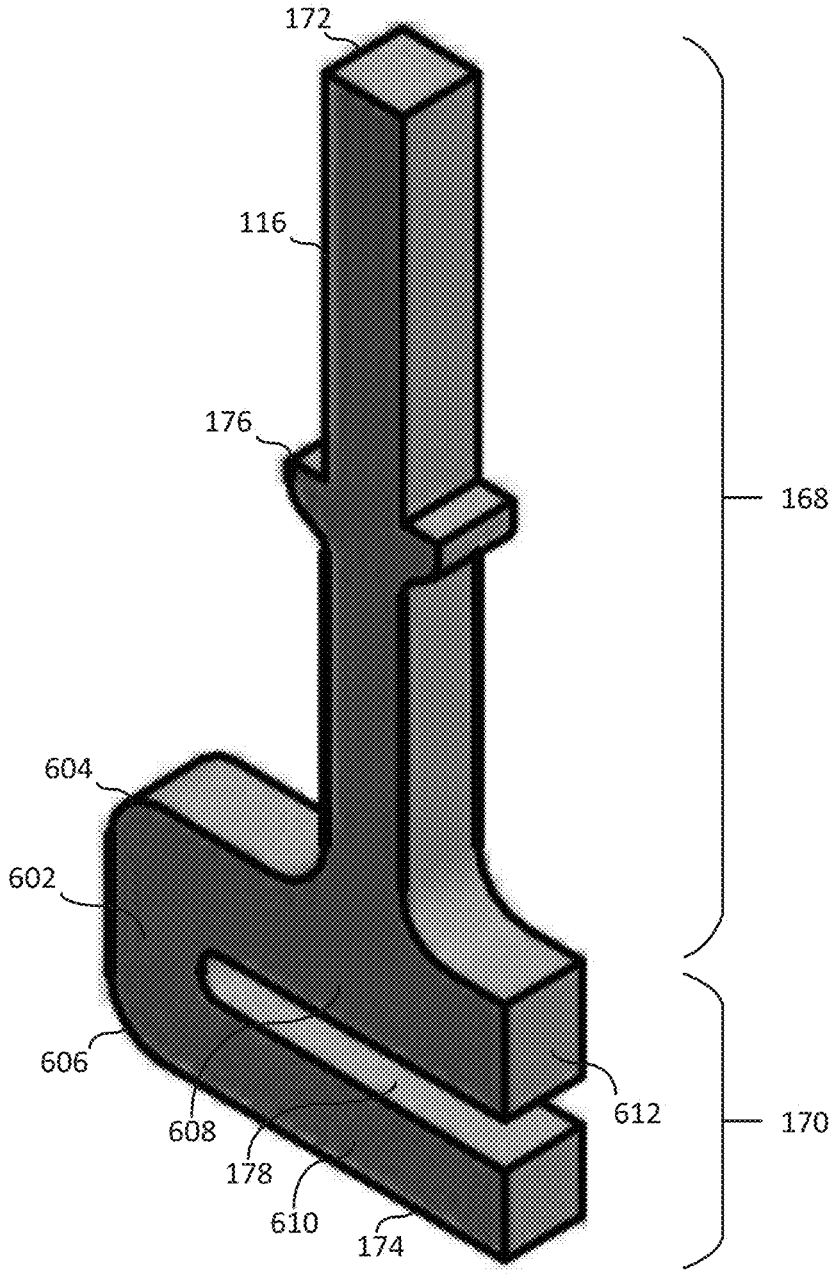
FIG. 6 is a perspective view of an example actuator shaft of the example proximity switch of FIGS. 1 and 2.
Figure 7:
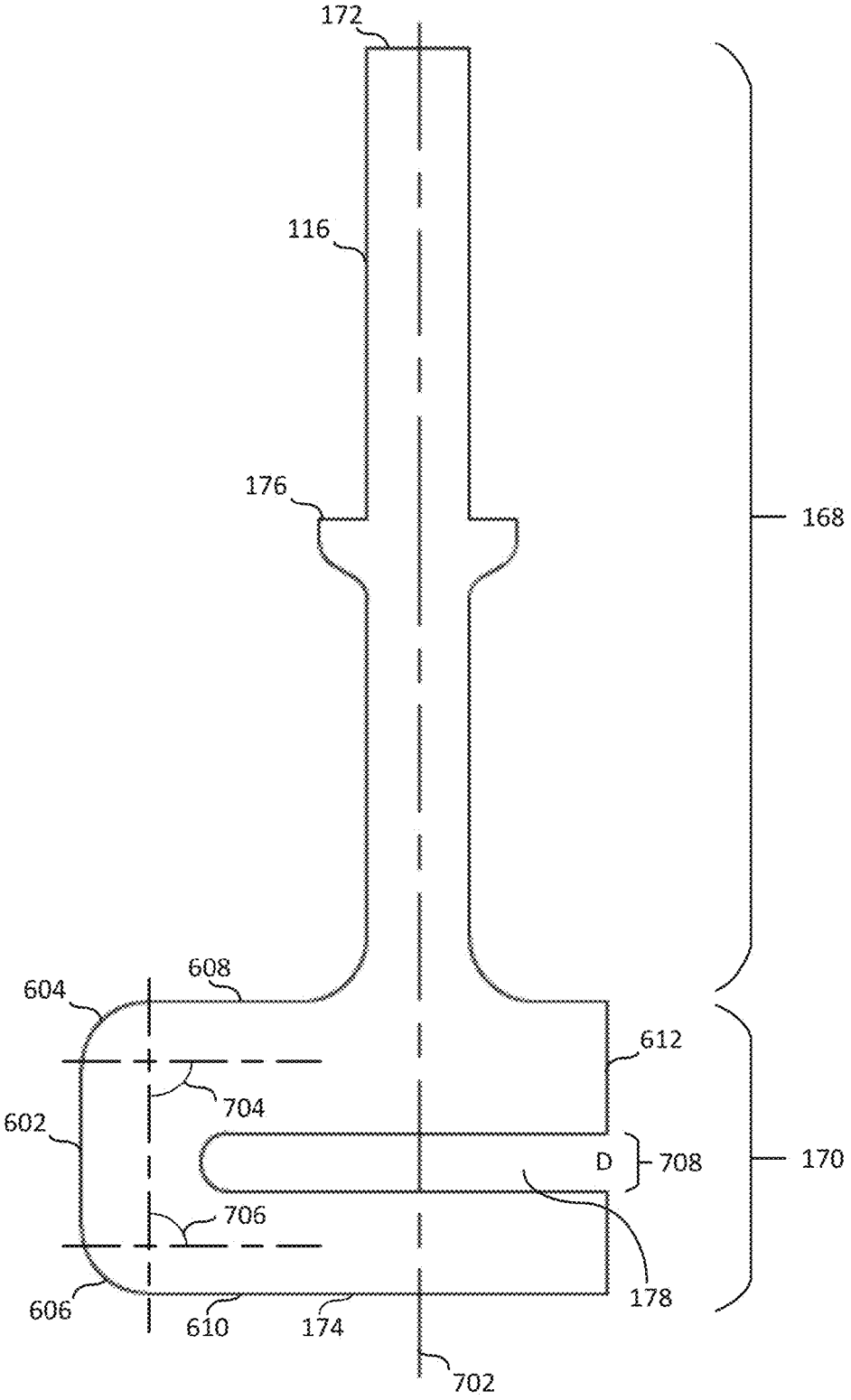
FIG. 7 is a side view of the example actuator shaft of FIGS. 1, 2 and 6.

FIGS. 6 and 7 are, respectively, perspective and side views of the actuator shaft 116 of FIGS. 1 and 2. The actuator shaft 116 of the proximity switch 100 includes an example first segment 168 and an example second segment 170. The first segment 168 defines an example first end 172 of the actuator shaft 116, while the second segment 170 defines an example second end 174 of the actuator shaft 116 opposite the first end 172. The first segment 168 further defines an example longitudinal axis 702 of the actuator shaft 116. The first segment 168 further includes an example mechanical stop 176. As described in greater detail below, the mechanical stop 176 may be implemented via one or more protrusion(s), widening(s), wing(s), seat(s) and/or flange(s) configured to prevent and/or stop a mechanical component from moving and/or passing beyond a location on the first segment 168 at which the mechanical stop 176 is positioned. When the actuator shaft 116 is positioned in the first body half 104 (as shown in FIG. 2) and/or the second body half 106 of the switch body 102, the second segment 170 of the actuator shaft 116 is positioned in the first cavity 128, and the first segment 168 of the actuator shaft 116 is positioned in the second and fourth cavities 130, 134. The actuator shaft 116 is movable within the switch body 102 along an axis that is substantially parallel to the longitudinal axis 702 of the actuator shaft 116.

In the illustrated example of FIGS. 1, 2, 6 and 7, the actuator shaft 116 has a generally rectangular cross section. In other examples, the cross section of the actuator shaft 116 may be circular, elliptical, triangular, and/or any other suitable polygonal shape. In the illustrated example, the cross section of the actuator shaft 116 is generally uniform along the actuator shaft 116 between the first and second ends 172, 174 of the actuator shaft 116. In other examples, the actuator shaft 116 may have one or more cross-sectional area(s) that differ at various points along the actuator shaft 116 between the first and second ends 172, 174 of the actuator shaft 116.

In the illustrated example, the first segment 168 of the actuator shaft 116 is configured to have a generally elongated rectangular shape that defines the longitudinal axis 702 of the actuator shaft 116. In other examples, the first segment 168 of the actuator shaft may be configured to have one or more other suitable polygonal shape(s) and/or one or more curved shape(s).

In the illustrated example, the second segment 170 of the actuator shaft 116 is configured to have a shape that defines an example slot 178. The slot 178 is configured to receive the middle portion 162 of the switch arm 114. In the illustrated example, the shape of the second segment 170 of the actuator shaft 116 generally resembles the shape of the letter "U". In such an example, the second segment 170 of the actuator shaft 116 includes an example base segment 602 having an example first end 604 and an example second end 606, an example first leg segment 608 extending from the first end 604 of the base segment 602 at an example first angle 704 relative to the base segment 602, and an example second leg segment 610 extending from the second end 606 of the base segment 602 at an example second angle 706 relative to the base segment 602. As shown, the first leg segment 608 is oriented relative to the base segment 602 at a first angle 704 of approximately ninety degrees, and the second leg segment 610 is oriented relative to the base segment 602 at a second angle 706 of approximately ninety degrees. In other examples, one or both of the first and/or second leg segment(s) 608, 610 may be oriented relative to the base segment 602 at an angle other than ninety degrees. In the illustrated example, the slot 178 is generally defined by the spacing and/or distance "D" 708 between the first and second leg segments 608, 610.

In the illustrated example, the base segment 602, the first leg segment 608, and the second leg segment 610 are each configured to have a generally elongated rectangular shape. In other examples, one or more of the base segment 602, the first leg segment 608 and/or the second leg segment 610 may be configured to have one or more other suitable polygonal shape(s) and/or one or more curved and/or non-linear shape(s).

In the illustrated example, the base segment 602 is substantially parallel to the first segment 168, the first leg segment 608 is substantially parallel to the second leg segment 610, and the first and second leg segments 608, 610 are both substantially perpendicular to the first segment 168 as well as the base segment 602. In other examples, alternate spatial relationships and/or angles may exist between and/or among the first segment 168, the base segment 602, the first leg segment 608 and/or the second leg segment 610.

In the illustrated example, the first segment 168 and the second segment 170 are integrally formed, as are the base segment 602, the first leg segment 608, and the second leg segment 610 of the second segment 170. In other examples, one or more of the first segment 168, the second segment 170, the base segment 602, the first leg segment 608 and/or the second leg segment 610 may be separate components that are coupled together via any type of suitable fastener(s) and/or adhesive(s). For example, the first segment 168 may be a separate component from the second segment 170. As another example, one or both of the first and/or second leg segment(s) 608, 610 may be a separate component from the base segment 602.

In the illustrated example, the first segment 168 intersects the first leg segment 608 at a point that is located between a free end 612 of the first leg segment 608 and the point at which the first leg segment 608 intersects the base segment 602. In other examples, the first segment 168 may intersect the first leg segment 608 at a point that is immediately adjacent the free end 612 of the first leg segment 608. In other examples, the first segment 168 may intersect the base segment 602, and/or may intersect the point at which the first leg segment 168 intersects the base segment 602.

The example bias magnet 118 of the proximity switch 100 has a circular cross section and a generally cylindrical and/or disc-like shape. The bias magnet 118 includes an example through hole and/or aperture 180 positioned proximate the center of the circular cross section of the bias magnet 118. The bias magnet 118 is configured to have a north pole associated with a first surface of the bias magnet 118 and a south pole associated with a second surface of the bias magnet 118 opposite the first surface. In the illustrated example of FIG. 1, the north pole of the bias magnet 118 is oriented toward the second end 174 of the actuator shaft 116, and the south pole of the bias magnet 118 is oriented away from the second end 174 of the actuator shaft 116. In other examples, the south pole of the bias magnet 118 may be oriented toward the second end 174 of the actuator shaft 116, and the north pole of the bias magnet 118 may be oriented away from the second end 174 of the actuator shaft 116. When the bias magnet 118 is positioned in the first body half 104 (as shown in FIG. 2) and/or the second body half 106 of the switch body 102, the bias magnet 118 is rigidly positioned in the third cavity 132.

Figure 8:
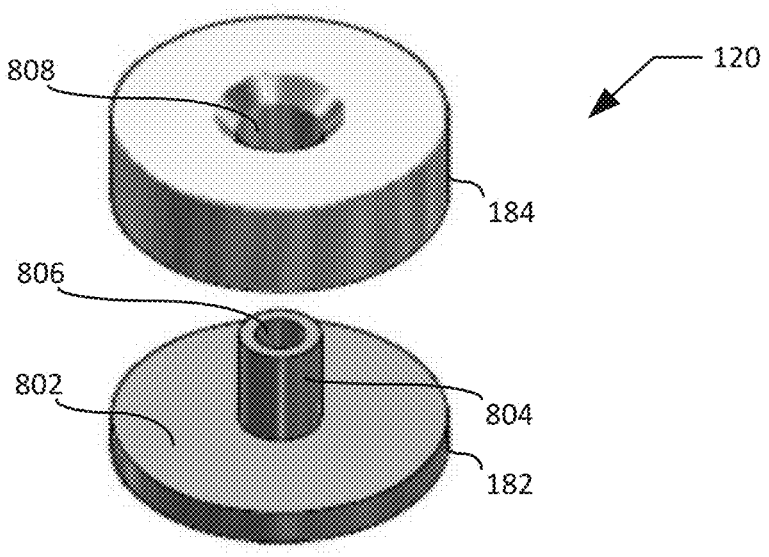
FIG. 8 is an exploded view of an example detector magnet assembly of the example proximity switch of FIGS. 1 and 2 showing an example detector magnet retainer and an example detector magnet.

FIG. 8 is an exploded view of the detector magnet assembly 120 of FIGS. 1 and 2. The detector magnet assembly 120 of the proximity switch 100 includes an example detector magnet retainer 182 and an example detector magnet 184. The detector magnet retainer 182 includes an example first portion 802 having a circular cross section and a generally cylindrical and/or disc-like shape, and an example second portion 804 having a circular cross section and a generally cylindrical shape that extends from the first portion 802 to form a stem. The detector magnet retainer 182 further includes an example through hole and/or aperture 806 positioned proximate the center of the circular cross section of the detector magnet retainer 182. The aperture 806 passes through both the first and second portions 802, 804 of the detector magnet retainer 182.

The detector magnet retainer 182 is configured to receive the detector magnet 184. The detector magnet 184 has a circular cross section and a generally cylindrical shape. The detector magnet 184 includes an example through hole and/or aperture 808 positioned proximate the center of the circular cross section of the detector magnet 184 configured to enable the second portion 804 and/or stem of the detector magnet retainer 182 to extend through the aperture 808 of the detector magnet 184. The detector magnet 184 is configured to have a north pole associated with a first surface of the detector magnet 184 and a south pole associated with a second surface of the detector magnet 184 opposite the first surface. The respective polarities of the detector magnet 184 and the bias magnet 118 are oriented in the same direction. For example, as illustrated in FIG. 1, the north poles of the detector magnet 184 and the bias magnet 118 are oriented toward the second end 174 of the actuator shaft 116, and the south poles of the detector magnet 184 and the bias magnet 118 are oriented away from the second end 174 of the actuator shaft 116. In other examples, the south poles of the detector magnet 184 and the bias magnet 118 may be oriented toward the second end 174 of the actuator shaft 116, and the north poles of the detector magnet 184 and the bias magnet 118 may be oriented away from the second end 174 of the actuator shaft 116. When the detector magnet assembly 120 is positioned in the first body half 104 (as shown in FIG. 2) and/or the second body half 106 of the switch body 102, the detector magnet assembly 120 is positioned in the fifth cavity 136. The detector magnet assembly 120 is movable within the switch body 102 along an axis that is substantially parallel to the longitudinal axis 702 of the actuator shaft 116.

Figure 9:
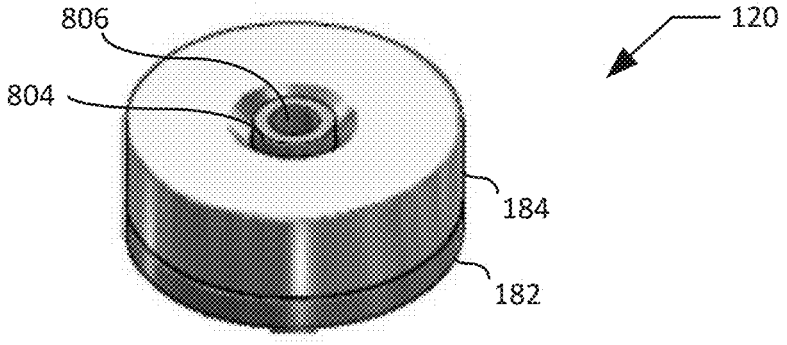
FIG. 9 is a perspective view of the example detector magnet assembly of FIGS. 1, 2 and 8 showing the example detector magnet positioned on the example detector magnet retainer.

The manufacture and/or assembly of certain components of the proximity switch 100 is/are described herein. In conjunction with manufacturing and/or assembling the proximity switch 100, the detector magnet 184 is oriented relative to the detector magnet retainer 182 such that the detector magnet 184 will be drawn toward the bias magnet 118 when the proximity switch 100 is fully assembled. Once properly oriented, the detector magnet 184 is seated and/or positioned on the detector magnet retainer 182 by inserting the second portion 804 and/or stem of the detector magnet retainer 182 through the aperture 808 of the detector magnet 184 and abutting the detector magnet 184 against the first portion 802 of the detector magnet retainer 182. In some examples, the aperture 808 of the detector magnet 184 is dimensioned to allow the second portion 804 and/or stem of the detector magnet retainer 182 to pass through the aperture 808 of the detector magnet 184 without interference. In other examples, the aperture 808 of the detector magnet 184 is dimensioned to provide a friction fit between the detector magnet 184 and the second portion 804 and/or stem of the detector magnet retainer 182. FIG. 9 is a perspective view of the detector magnet assembly 120 of FIGS. 1, 2 and 8 showing the detector magnet 184 positioned on the detector magnet retainer 182.

Figure 10:
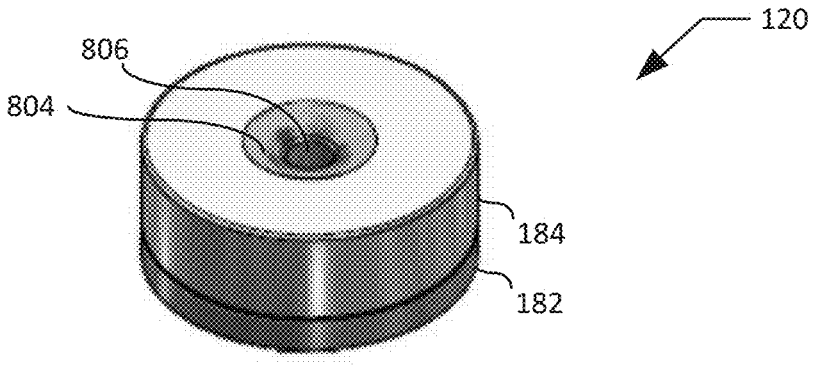
FIG. 10 is a perspective view of the example detector magnet assembly of FIGS. 1, 2, 8 and 9 showing the example detector magnet coupled to the example detector magnet retainer.

After the detector magnet 184 has been positioned on the detector magnet retainer 182, a swaging operation is performed on the second portion 804 and/or stem of the detector magnet retainer 182 to increase the cross section of the second portion 804 and to couple the detector magnet 184 to the detector magnet retainer 182 to form the detector magnet assembly 120. FIG. 10 is a perspective view of the detector magnet assembly 120 of FIGS. 1, 2, 8 and 9 showing the detector magnet 184 coupled to the detector magnet retainer 182 as a result of the swaging operation described above.

In further conjunction with manufacturing and/or assembling the proximity switch 100, the first end 172 of the actuator shaft 116 is inserted through the aperture 180 of the bias magnet 118, and the bias magnet 118 is moved to a position past the mechanical stop 176 of the actuator shaft 116. In some examples, the aperture 180 of the bias magnet 118 is dimensioned to allow the actuator shaft 116 and the mechanical stop 176 to pass through the aperture 180 of the bias magnet 118 without interference.

After the detector magnet assembly 120 has been formed as described above and after the bias magnet 118 has been positioned on the actuator shaft 116, the first end 172 of the actuator shaft 1114 is inserted through the aperture 806 of the detector magnet retainer 182, and the detector magnet assembly 120 is moved to a position abutting the mechanical stop 176 of the actuator shaft 116. In some examples, the aperture 806 of the detector magnet retainer 182 is dimensioned to allow the first segment 168 between the first end 172 and the mechanical stop 176 of the actuator shaft 116 to pass through the aperture 806 of the detector magnet retainer 182 without interference. In other examples, the aperture 806 of the detector magnet retainer 182 is dimensioned to provide a friction fit between the detector magnet retainer 182 and the first segment 168 between the first end 172 and the mechanical stop 176 of the actuator shaft 116.

Figure 11:
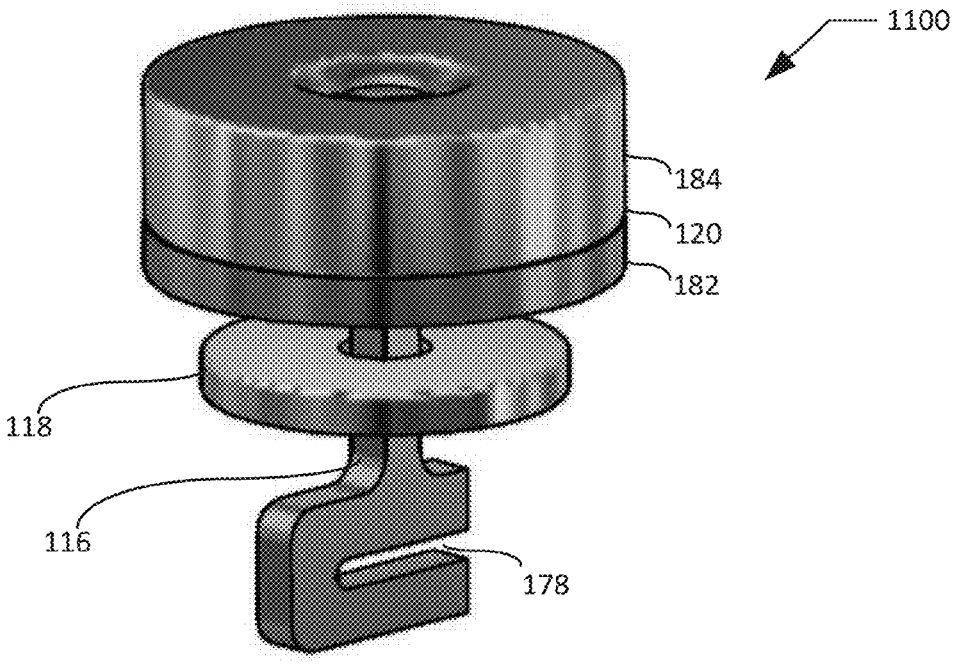
FIG. 11 is a perspective view of an example actuator shaft/magnet assembly including the example actuator shaft, the example bias magnet, and the example detector magnet assembly of FIGS. 1, 2, 6, 7 and 10.
Figure 12:
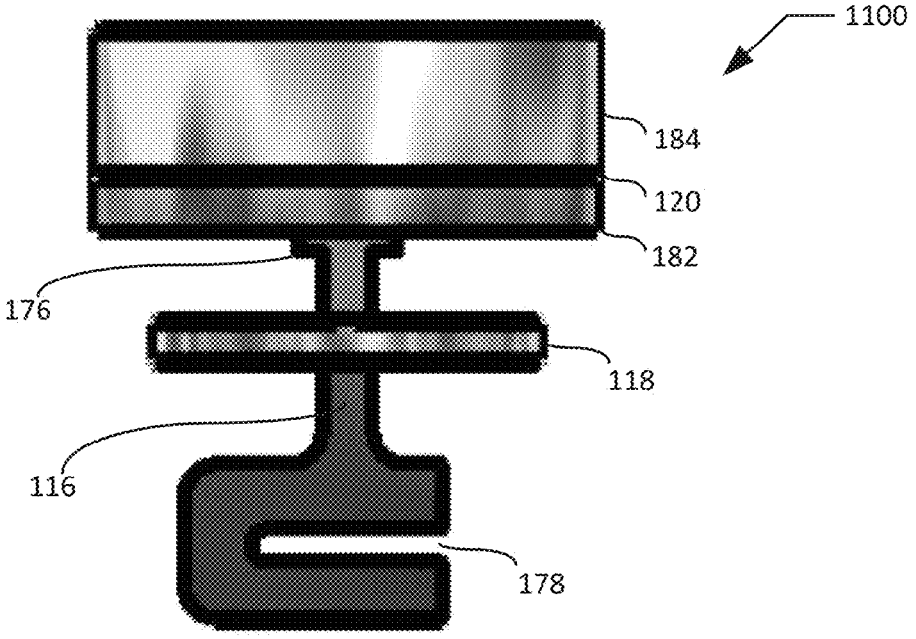
FIG. 12 is a side view of the example actuator shaft/magnet assembly of FIG. 11.

After the detector magnet assembly 120 has been positioned against the mechanical stop 176 of the actuator shaft 116, a swaging operation is performed on the first end 172 of the actuator shaft 116 to increase the cross section of the first end 172 and to couple the detector magnet assembly 120 to the actuator shaft 116. FIGS. 11 and 12 are, respectively, a perspective view and a side view showing an example actuator shaft/magnet assembly 1100 formed as a result of the bias magnet 18 and the detector magnet assembly 120 being coupled to the actuator shaft 116. The actuator shaft/magnet assembly 1100 includes the actuator shaft 116, the bias magnet 118, and the detector magnet assembly 120.

In further conjunction with manufacturing and/or assembling the proximity switch 100, the middle portion 162 of the switch arm 114 is positioned in the slot 178 of the actuator shaft 116 to form an example actuation assembly that includes the switch arm 114, the actuator shaft 116, the bias magnet 118, and the detector magnet assembly 120. The manufacture and/or assembly of the proximity switch 100 further includes positioning the common, primary and secondary terminals 108, 110, 112 in the first body half 104 and/or the second body half 106 of the switch body 102, and further positioning the switch arm 114, the actuator shaft/magnet assembly 1100, and/or the example actuation assembly in the first body half 104 and/or the second body half 106 of the switch body 102 such that the hook segment 144 of the common terminal 108 is received in the ring segment 164 of the switch arm 114, and such that the common contact 166 of the switch arm 114 is positioned between the primary contact 150 of the primary terminal 110 and the secondary contact 156 of the secondary terminal 112.

In operation, the example proximity switch 100 detects the presence and/or proximity of a target without physically contacting the target. The target may include a ferrous object or a permanent magnet contained in a housing. When the target is beyond a specified range of the proximity switch 100, a magnetic flux associated with the bias magnet 118 that is non-movably positioned in the proximity switch 100 causes the detector magnet assembly 120 that is movably positioned in the proximity switch 100 to be drawn toward the bias magnet 118 along the longitudinal axis 702 defined by the actuator shaft 116. When the detector magnet assembly 120 is drawn toward the bias magnet 118, the respective couplings between the detector magnet assembly 120 and the actuator shaft 116, and between the actuator shaft 116 and the switch arm 114, cause the switch arm 114 to pivotably rotate relative to the common terminal 108 such that the switch arm 114 is placed in a first switch position. In the first switch position, the common contact 166 of the switch arm 114 electrically contacts the primary contact 150 of the primary terminal 110, and does not electrically contact the secondary contact 156 of the secondary terminal 112. Thus, in the first switch position, an electrically conductive path or circuit is formed between the common terminal 108 and the primary terminal 110, but not between the common terminal 108 and the secondary terminal 112.

When the target passes within the specified range of the proximity switch 100, a magnetic flux associated with the target triggers and/or causes the detector magnet assembly 120 to be drawn toward the target and away from the bias magnet 118 along the longitudinal axis 702 defined by the actuator shaft 116. When the detector magnet assembly 120 is drawn toward the target and away from the bias magnet 118, the respective couplings between the detector magnet assembly 120 and the actuator shaft 116, and between the actuator shaft 116 and the switch arm 114, cause the switch arm 114 to pivotably rotate relative to the common terminal 108 such that the switch arm 114 is placed in a second switch position. In the second switch position, the common contact 166 of the switch arm 114 electrically contacts the secondary contact 156 of the secondary terminal 112, and does not electrically contact the primary contact 150 of the primary terminal 110. Thus, in the second switch position, an electrically conductive path or circuit is formed between the common terminal 108 and the secondary terminal 112, but not between the common terminal 108 and the primary terminal 110.

The example actuation assembly of the proximity switch 100 described above provides numerous advantages over the actuation assembly of the known proximity switch described in U.S. Pat. No. 8,362,859. For example, unlike the known proximity switch, the example proximity switch 100 includes an actuator shaft 116 having a slot 178 configured to receive a portion 162 of a switch arm 114. The example configuration of the actuator shaft 116 and the switch arm 114 provides for increased control of the interface tolerance between the switch arm 114 and the actuator shaft 116, which decreases the variability associated with manufacturing and/or assembling proximity switches implementing the improved actuation apparatus. The interface of the switch arm 114 and the actuator shaft 116 also provides for a decrease in the time associated with manufacturing and/or assembling a proximity switch implementing the improved actuation apparatus. Furthermore, unlike the switch arm of the known proximity switch, the switch arm 114 of the example proximity switch 100 does not include an aperture proximate the middle portion 162 of the switch arm 114. As a result of eliminating the aperture, the switch arm 114 of the example proximity switch 100 is stronger and/or more robust relative to the switch arm of the known proximity switch. As a further result of eliminating the aperture, the manufacturing and/or machining process used to form the switch arm 114 of the example proximity switch 100 is simplified relative to the manufacturing and/or machining process used to form the switch arm of the known proximity switch.

Although certain apparatus, systems and methods have been described herein, the scope of coverage of this patent is not limited thereto. On the contrary, this patent covers all apparatus, systems and methods fairly falling within the scope of the appended claims either literally or under the doctrine of equivalents.

What is claimed is:

1. An apparatus, comprising:

an actuator shaft including a first segment and a second segment, the first segment intersecting the second segment, the first segment defining a first end of the actuator shaft, the second segment defining a second end of the actuator shaft opposite the first end and further defining a slot, the second segment including a base segment, a first leg segment, and a second leg segment, the second leg segment being spaced apart from the first leg segment;

a detector magnet assembly coupled to the first segment of the actuator shaft adjacent the first end of the first segment; and a switch arm coupled to the second segment of the actuator shaft, the switch arm including a first end, a second end opposite the first end of the switch arm, and a portion located between the first and second ends of the switch arm, the portion being positioned in the slot of the actuator shaft.

2. The apparatus as defined in claim 1, wherein the first and second segments are integrally formed.

3. The apparatus as defined in claim 1, wherein the first segment further defines a longitudinal axis of the actuator shaft.

4. The apparatus as defined in claim 1, wherein the first segment includes a mechanical stop, the detector magnet assembly abutting the mechanical stop.

5. The apparatus as defined in claim 1, wherein the first segment intersects the first leg segment of the second segment.

6. The apparatus as defined in claim 1, wherein the base segment includes a first end and a second end opposite the first end, the first leg segment extending from the first end of the base segment at a first angle, the second leg segment extending from the second end of the base segment at a second angle.

7. The apparatus as defined in claim 1, wherein the base segment of the second segment is substantially parallel to the first segment.

8. The apparatus as defined in claim 1, wherein the first leg segment is substantially parallel to the second leg segment.

9. The apparatus as defined in claim 8, wherein the first leg segment is substantially perpendicular to the base segment.

10. The apparatus as defined in claim 1, wherein the detector magnet assembly includes a detector magnet and a detector magnet retainer, the detector magnet including a first aperture configured to receive the detector magnet retainer, the detector magnet retainer including a second aperture configured to be positioned within the first aperture of the detector magnet and further configured to receive the first end of the first segment of the actuator shaft.

11. The apparatus as defined in claim 1, wherein the switch arm includes a ring segment adjacent the first end of the switch arm and a common contact adjacent the second end of the switch arm.

12. The apparatus as defined in claim 11, wherein the switch arm is configured to be pivotably movable between a first switch position and a second switch position.

13. A method, comprising:

coupling a detector magnet to a detector magnet retainer to form a detector magnet assembly, the detector magnet including a first aperture configured to receive the detector magnet retainer;

coupling the detector magnet assembly to a first segment of an actuator shaft, the detector magnet assembly abutting a mechanical stop positioned on the first segment of the actuator shaft; and coupling a switch arm to a second segment of the actuator shaft, the second segment intersecting the first segment, the switch arm including a first end, a second end opposite the first end, and a portion located between the first and second ends of the switch arm, the portion configured to be positioned in a slot defined by the second segment of the actuator shaft.

14. The method as defined in claim 13, wherein coupling the detector magnet to the detector magnet retainer includes swaging the detector magnet retainer.

15. The method as defined in claim 13, wherein coupling the detector magnet assembly to the first segment of the actuator shaft includes swaging the first segment of the actuator shaft, the detector magnet retainer including a second aperture configured to be positioned within the first aperture of the detector magnet and further configured to receive the first segment of the actuator shaft.

16. An apparatus, comprising:

an actuator shaft including a first segment and a second segment, the first segment intersecting the second segment, the first segment defining a first end of the actuator shaft, the second segment defining a second end of the actuator shaft opposite the first end and further defining a slot, the first segment including a mechanical stop, the first segment configured to be coupled to a detector magnet assembly to be positioned adjacent the first end of the first segment, the detector magnet assembly to abut the mechanical stop of the first segment, the second segment including a base segment, a first leg segment, and a second leg segment, the second leg segment being spaced apart from the first leg segment, the second segment configured to be coupled to a switch arm, the switch arm including a first end, a second end opposite the first end, and a portion located between the first and second ends of the switch arm, the slot of the second segment configured to receive the portion of the switch arm.

17. The apparatus as defined in claim 16, wherein the first segment intersects the first leg segment of the second segment.

18. The apparatus as defined in claim 16, wherein the base segment includes a first end and a second end opposite the first end, the first leg segment extending from the first end of the base segment at a first angle, the second leg segment extending from the second end of the base segment at a second angle.

19. The apparatus as defined in claim 16, wherein the base segment of the second segment is substantially parallel to the first segment.

20. The apparatus as defined in claim 16, wherein the detector magnet assembly includes a detector magnet and a detector magnet retainer, the detector magnet including a first aperture configured to receive the detector magnet retainer, the detector magnet retainer including a second aperture configured to be positioned within the first aperture of the detector magnet and further configured to receive the first end of the first segment of the actuator shaft.

* * * * *